US009726086B2

(12) United States Patent
Tsutsumi

(10) Patent No.: US 9,726,086 B2
(45) Date of Patent: Aug. 8, 2017

(54) FAILURE DIAGNOSIS DEVICE FOR EXHAUST BRAKE

(71) Applicant: HINO MOTORS, LTD., Hino-shi (JP)

(72) Inventor: Munechika Tsutsumi, Tokyo (JP)

(73) Assignee: HINO MOTORS, LTD., Hino-shi (JP)

( * ) Notice: Subject to any disclaimer, the term of this patent is extended or adjusted under 35 U.S.C. 154(b) by 0 days.

(21) Appl. No.: 14/787,612

(22) PCT Filed: Jul. 8, 2014

(86) PCT No.: PCT/JP2014/068178
§ 371 (c)(1),
(2) Date: Oct. 28, 2015

(87) PCT Pub. No.: WO2015/005336
PCT Pub. Date: Jan. 15, 2015

(65) Prior Publication Data

US 2016/0084170 A1 Mar. 24, 2016

(30) Foreign Application Priority Data

Jul. 10, 2013 (JP) ..... 2013-144155

(51) Int. Cl.

| | |
|---|---|
| ***F02D 9/06*** | (2006.01) |
| ***F02D 41/22*** | (2006.01) |
| ***F02D 41/18*** | (2006.01) |
| *F02D 41/12* | (2006.01) |

(52) U.S. Cl.
CPC ..... *F02D 9/06* (2013.01); *F02D 41/18* (2013.01); *F02D 41/221* (2013.01); *F02D 41/123* (2013.01); *F02D 2200/0614* (2013.01); *F02D 2250/34* (2013.01)

(58) Field of Classification Search
CPC ..... F02D 9/06; F02D 41/18; F02D 41/221; F02D 41/123; F02D 2200/0614; F02D 2250/34
USPC ..... 123/320, 339.15, 676, 690, 479; 701/103, 107, 110, 112; 73/114.76
See application file for complete search history.

(56) References Cited

FOREIGN PATENT DOCUMENTS

| | | |
|---|---|---|
| JP | 2008-128114 A | 6/2008 |
| JP | 2010-261330 A | 11/2010 |

OTHER PUBLICATIONS

International Search Report issued on Oct. 7, 2014 for PCT/JP2014/068178 filed on Jul. 8, 2014.

*Primary Examiner* — Hai Huynh
(74) *Attorney, Agent, or Firm* — Oblon, McClelland, Maier & Neustadt, L.L.P.

(57) ABSTRACT

On the basis of absolute values α and β of variations, before and after actuation of an exhaust brake, of fuel-injection and intake-air amounts, respectively, an exhaust brake is determined to normally operate when the absolute values α and β of the variations of the fuel-injection and intake-air amounts are not less than fuel-injection and intake-air variation thresholds, respectively; the exhaust brake is determined to have failure when the absolute values α and β of the variations of the fuel-injection and intake-air amounts are less than the fuel-injection and intake-air variation thresholds, respectively.

2 Claims, 4 Drawing Sheets

FAILURE DIAGNOSIS DEVICE FOR EXHAUST BRAKE

TECHNICAL FIELD

The present invention relates to a device for diagnosing failure of an exhaust brake.

BACKGROUND ART

Conventionally, an aftertreatment device is incorporated in an exhaust pipe for a diesel engine to conduct exhaust emission control. Known as this kind of aftertreatment devices are a particulate filter which captures particulates (particulate matter) discharged from a diesel engine as well as a selective reduction catalyst with a property of selectively reacting $NO_x$ (nitrogen oxides) with a reducing agent even in the presence of oxygen.

The particulate filter comprises a filter body with a porous honeycomb structure made of ceramics such as cordierite and having lattice-like compartmentalized passages; alternate ones of the passages have plugged inlets and the remaining passages with unplugged open inlets have plugged outlets. Only the exhaust gas passing through thin porous walls compartmentalizing the respective passages is discharged downstream, and the particulates in the exhaust gas are captured by and accumulated on inner surfaces of the thin porous walls. Thus, the particulate filter is to be regenerated through burning and removal of the particulates before exhaust resistance is increased due to clogging by the particulates.

Meanwhile, well known in a field of industrial flue gas denitration in a plant or the like is effectiveness of using ammonia as a reducing agent for reduction and depuration of $NO_x$. However, in a field of automobile where problematic is running with ammonia itself loaded, researches have been made nowadays on use of nontoxic urea water as a reducing agent. More specifically, addition of urea water into exhaust gas upstream of a selective reduction catalyst brings about thermal decomposition of the urea water into ammonia and carbon dioxide in the exhaust gas, leading to satisfactory reduction and depuration of $NO_x$ in the exhaust gas by ammonia on the selective reduction catalyst. Since urea water freezes at a temperature of −13.5° C. or less, it is necessary for a vehicle assumed to be used in a cold weather region to have provision for unfreezing of urea water having frozen in a urea water tank or midway of a urea water supply line. To this end, an coolant piping having engine coolant flowing therethrough is wrapped around an outer periphery of the urea water tank or of the urea water supply line and the coolant flowing through the coolant piping is enhanced in temperature to unfreeze the freezing urea water.

In order to regenerate the particulate filter as the aftertreatment device or unfreeze the urea water for the selective reduction catalyst as the aftertreatment device, an exhaust flow rate is throttled by exhaust throttle means during idling to rise a pressure of the exhaust gas upstream of the exhaust throttle means and thus rise an exhaust temperature. Further, the increase in exhaust resistance makes it difficult for relatively low-temperatured intake air to flow into cylinders of the engine and thus increases a remained amount of relatively high-temperatured exhaust gas; air in the cylinders including such relatively high-temperatured exhaust gas in much quantity, which is compressed in a next compression stroke and enters into an expansion stroke, attains further rising of the exhaust temperature and a warm-up operation of the diesel engine associated therewith rises the temperature of the coolant. The exhaust throttle means normally used is an exhaust brake incorporated in the exhaust pipe.

In this connection, if the exhaust brake as the exhaust throttle means were excessively closed, then load would become excessively high, resulting in failed rotation of the diesel engine; to the contrary, the exhaust brake, which were excessively opened, would fail in rising of the exhaust temperature. Therefore, it is very important to determine whether load increase by the exhaust brake as the exhaust throttle means is proper or not.

There exists, for example, Patent Literature 1 showing general state of the art pertinent to a device for determining whether load increase by an exhaust brake is proper or not.

CITATION LIST

Patent Literature

[Patent Literature 1] JP 2010-261330A

SUMMARY OF INVENTION

Technical Problems

Recently obliged in countries is equipment of a so-called on-board diagnosis device (OBD) to a vehicle to monitor any failure in an exhaust gas countermeasure system; upon failure occurrence, it turns on a warning light, makes a warning beep or the like for announcement of a portion of failure occurrence and failure details to a driver and records codes depending on the failure.

However, it is hard in an existing on-board diagnosis device to detect any unexpected failure in regeneration of a particulate filter and/or unfreezing of urea water for a selective reduction catalyst due to, for example, caught foreign matters in moving parts of an exhaust brake and resultant seizure of the brake being closed. Thus, it has been desired to enable diagnosis on failure of the exhaust brake.

The invention was made in view of the above and has its object to provide a device for diagnosing failure of an exhaust brake which can detect the failure of the exhaust brake and can surely attain temperature rise of the exhaust gas required for regeneration of a particulate filter and for unfreezing of urea water for a selective reduction catalyst.

Solution to Problems

The invention is directed to a device for diagnosing failure of an exhaust brake which throttles an exhaust flow rate to rise a temperature of an aftertreatment device for exhaust emission control incorporated in an exhaust pipe of an engine to an required temperature during idling, comprising a diagnosis circuit for determining, on the basis of absolute values of variations, before and after actuation of said exhaust brake, of fuel-injection and intake-air amounts, respectively, that the exhaust brake normally operates when the absolute value of the variation, before and after the actuation of said exhaust brake, of the fuel-injection amount is not less than a fuel-injection variation threshold and the absolute value of the variation, before and after the actuation of said exhaust brake, of the intake-air amount is not less than an intake-air variation threshold and determining that said exhaust brake has failure when the absolute value of the variation, before and after the actuation of said exhaust brake, of said fuel-injection amount is less than the fuel-injection variation threshold and the absolute value of the variation, before and after the actuation of said exhaust brake, of said intake-air amount is less than the intake-air variation threshold.

In said device for diagnosing failure of the exhaust brake, it is preferable for prevention of false determination that said diagnosis circuit sets a first diagnosis-avoidance zone where no diagnosis is made when the absolute value of the variation of said fuel-injection amount is not less than the fuel-injection variation threshold and the absolute value of the variation of said intake-air amount is less than the intake-air variation threshold as well as a second diagnosis-avoidance zone where no diagnosis is made when the absolute value of the variation of said fuel-injection amount is less than the fuel-injection variation threshold and the absolute value of the variation of said intake-air amount is not less than the intake-air variation threshold.

Advantageous Effects of Invention

A device for diagnosing failure of an exhaust brake according to the invention can exhibit excellent effects that the failure of the exhaust brake can be detected and exhaust temperature rise can be surely attained which is required for regeneration of a particulate filter and unfreezing of urea water for a selective reduction catalyst.

DESCRIPTION OF EMBODIMENT

Figure 1:
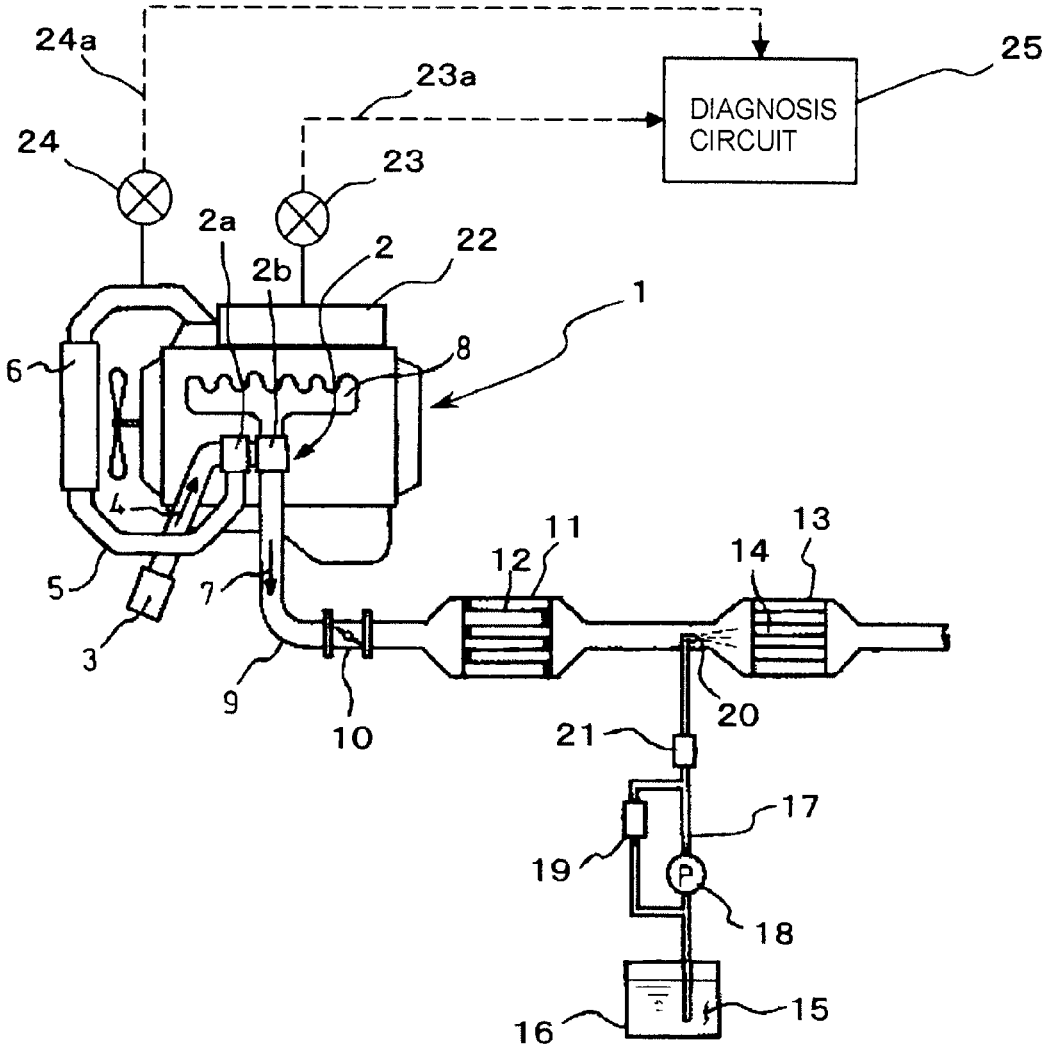
FIG. 1 is an overall schematic diagram showing an embodiment of a device for diagnosing failure of an exhaust brake according to the invention.

An embodiment of the invention will be described in conjunction with attached drawings.

FIGS. 1-4 show the embodiment of a device for diagnosing failure of an exhaust brake according to the invention. A diesel engine 1 illustrated is provided with a turbocharger 2 having a compressor 2*a* to which supplied as intake air through an intake pipe 5 is air 4 having been purified through an air cleaner 3. The air 4 pressurized by the compressor 2*a* is supplied to an intercooler 6 for cooling; the air cooled by the intercooler 6 is guided to an intake manifold (not shown) and then into respective cylinders of the diesel engine 1.

Exhaust gas 7 discharged from the cylinders of the diesel engine 1 is supplied through an exhaust manifold 8 to a turbine 2*b* of the turbocharger 2. The exhaust gas 7 having being supplied to and having driven the turbine 2*b* is discharged through an exhaust pipe 9 to outside of a vehicle.

Incorporated in the exhaust pipe 9 through which the exhaust gas 7 flows are an exhaust brake 10 as exhaust throttle means which throttles an exhaust flow rate so as to raise a temperature of the aftertreatment device for exhaust emission control to a required temperature during idling, a particulate filter 12 as an aftertreatment device encased by a casing 11 and a selective reduction catalyst 14 as an aftertreatment device encased by a casing 13. The particulate filter 12 has a porous honeycomb structure made of ceramics such as cordierite and having lattice-like compartmentalized flow passages; alternate ones of the flow passages have plugged inlet and the remaining flow passages with unplugged open inlets have plugged outlets. Only the exhaust gas 7 passing through thin porous walls compartmentalizing the respective flow passages is discharged downstream. The selective reduction catalyst 14 is formed, for example, as a flow-through type honeycomb structure and has a property capable of selectively reacting $NO_x$ with ammonia even in the presence of oxygen.

Incorporated in a urea water supply line 17 extending from a urea water tank 16 for storage of the urea water 15 are a supply pump 18 which pumps the urea water 15 in the urea water tank 16, a regulator 19 which regulates a pressure of the urea water 15 pumped by the supply pump 18, and an injector 21 which injects the urea water 15 regulated in pressure by the regulator 19 through an addition nozzle 20 into the exhaust pipe 9 upstream of the selective reduction catalyst 14.

In the embodiment, the fuel pump 22 mounted on the diesel engine 1 is provided with a fuel-injection amount sensor 23 for detection of a fuel-injection amount 23*a*. Incorporated in the intake pipe 5 is an intake-air amount sensor 24 for detection of an intake-air amount 24*a*. The fuel-injection and intake-air amounts 23*a* and 24*a* detected by the fuel-injection and intake-air amount sensors 23 and 24, respectively, are inputted to a diagnosis circuit 25.

Figure 2:
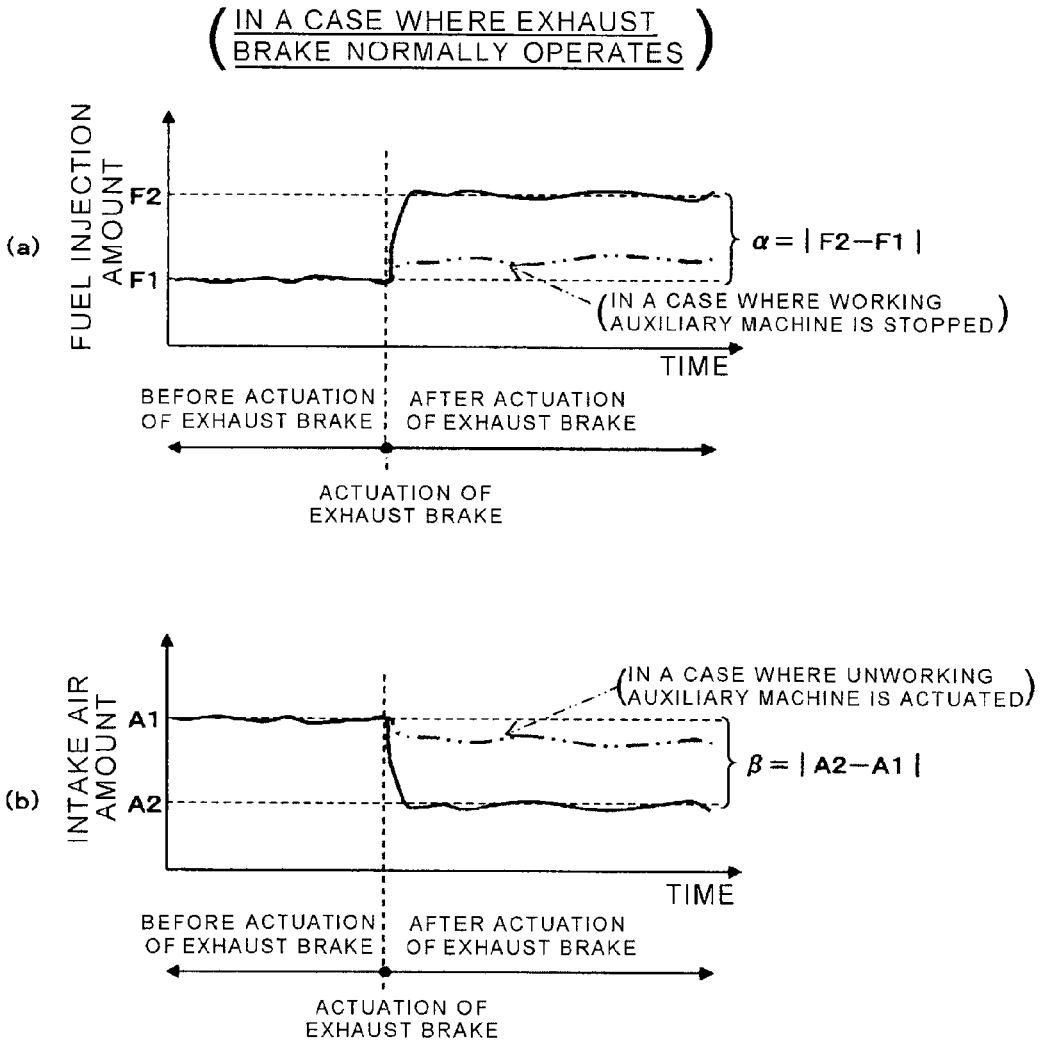
FIGS. 2(*a*) and 2(*b*) are diagrams showing variations of fuel-injection and intake-air amounts, respectively, when the exhaust brake normally operates in the embodiment of the device for detecting the failure of the exhaust brake according to the invention.
Figure 3:
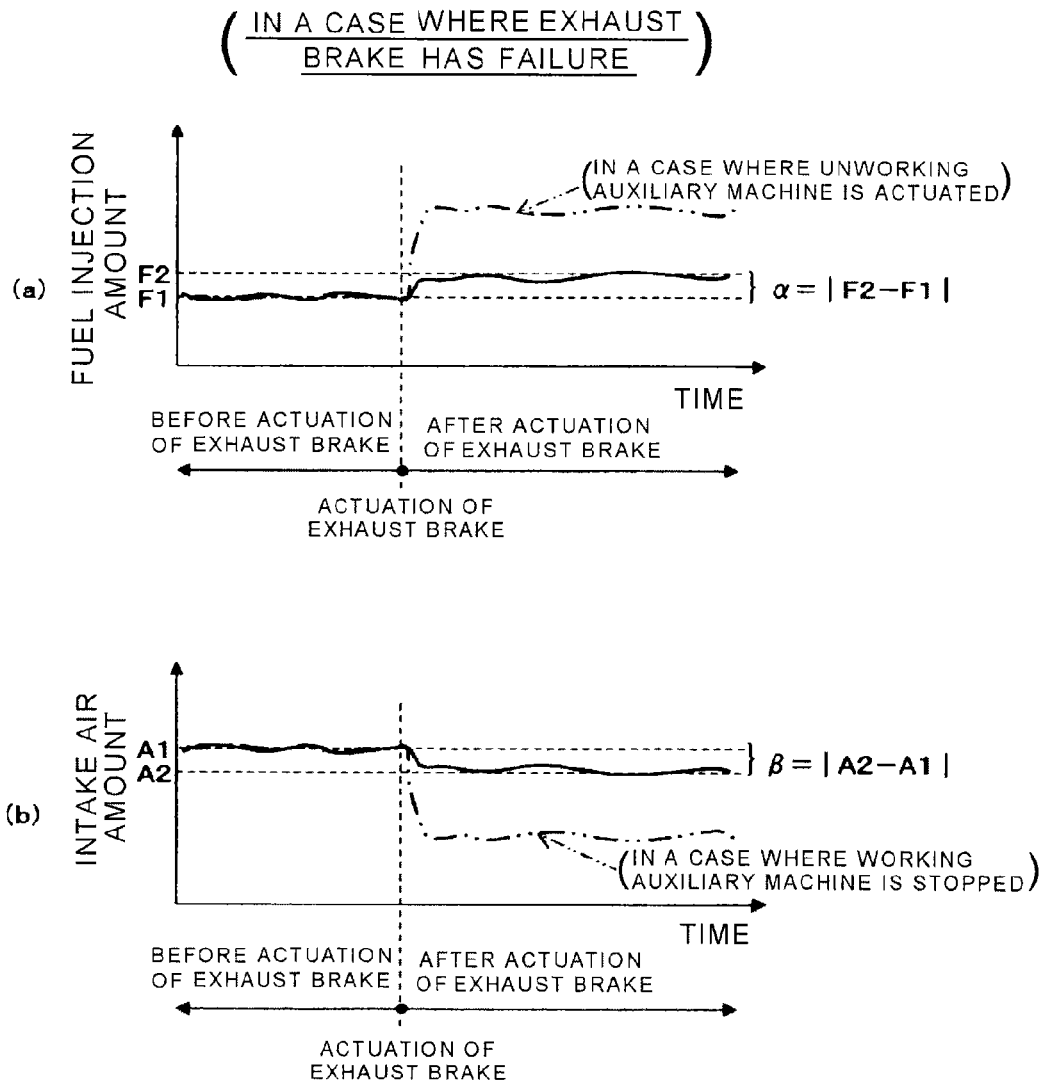
FIGS. 3(*a*) and 3(*b*) are diagrams showing variations of the fuel-injection and intake-air amounts, respectively, when the exhaust brake has failure in the embodiment of the device for detecting the failure of the exhaust brake according to the invention.

The diagnosis circuit 25 is adapted to determine, as shown in FIGS. 2 and 3, on the basis of an absolute value of a variation, before and after actuation of the exhaust brake 10, of a fuel-injection amount 23*a*, i.e., $$\alpha=|F2-F1|$$

where F1 and F2 are fuel-injection amounts before and after the actuation of the exhaust brake 10, respectively, as well as an absolute value of a variation, before and after the actuation of the exhaust brake 10, of an intake-air amount 24*a*, i.e., $$\beta=|A2-A1|$$

where A1 and A2 are intake-air amounts before and after the actuation of exhaust brake 10, respectively, that the exhaust brake 10 normally operates when the absolute value $\alpha$ of the variation of the fuel-injection amount 23*a* is not less than the fuel-injection variation threshold $\alpha 0$ ($\alpha \geq \alpha 0$) and the absolute value $\beta$ of the variation of the intake-air amount 24*a* is not less than the intake-air variation threshold $\beta 0$ ($\beta \geq \beta 0$) and that the exhaust brake 10 has failure when the absolute value $\alpha$ of the variation of the fuel-injection amount 23*a* is less than the fuel-injection variation threshold $\alpha 0$ ($\alpha < \alpha 0$) and the absolute value $\beta$ of the variation of the intake-air amount 24*a* is less than the intake-air variation threshold $\beta 0$ ($\beta < \beta 0$).

Figure 4:
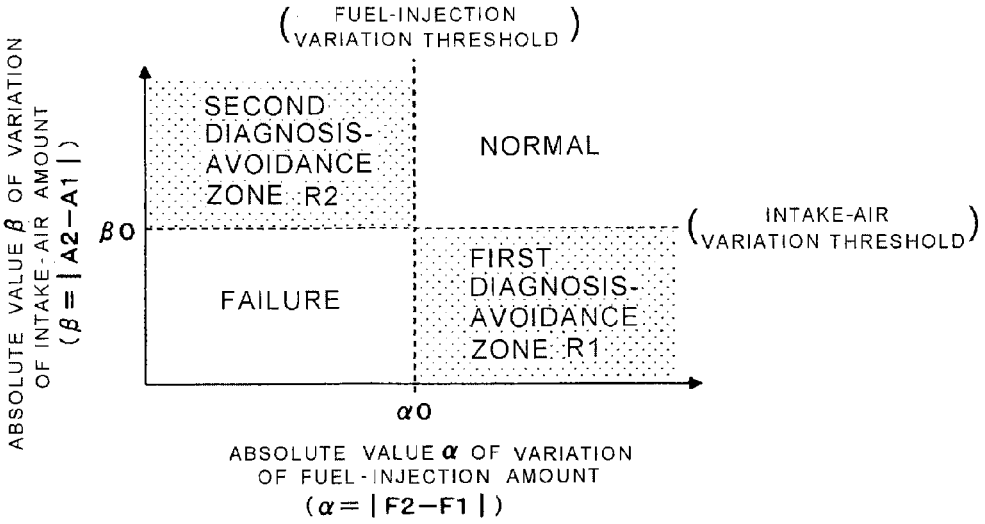
FIG. 4 is a diagram showing a map set to the diagnosis circuit in the embodiment of the device for detecting the failure of the exhaust brake according to the invention.

The diagnosis circuit 25 sets, as shown in FIG. 4, a first diagnosis-avoidance zone R1 where no diagnosis is made when the absolute values $\alpha$ of the variation of the fuel-injection amount 23*a* is not less than fuel-injection variation threshold $\alpha 0$ ($\alpha \geq \alpha 0$) and the absolute value $\beta$ of the variation of the intake-air amount 24*a* is less than the intake-air variation threshold $\beta 0$ ($\beta < \beta 0$) as well as a second diagnosis-avoidance zone R2 where no diagnosis is made when the absolute value $\alpha$ of the variation of the fuel-injection amount 23*a* is less than the fuel-injection variation threshold $\alpha 0$ ($\alpha<\alpha 0$) and the absolute value $\beta$ of the variation of the intake-air amount 24*a* is not less than the intake-air variation threshold $\beta 0$ ($\beta \geq \beta 0$).

The fuel-injection and intake-air amounts 23*a* and 24*a*, which are actually measured values in the embodiment, may be replaced with command values outputted from an engine control computers (ECU) (not shown).

Next, mode of operation of the above embodiment will be described.

When outputted is an actuation request for the exhaust brake 10 as the exhaust throttle means during idling of the diesel engine 1, an absolute value $\alpha$ (=|F2−F1|) of a variation, before and after the actuation of the exhaust brake 10, of the fuel-injection amount 23*a* and an absolute value $\beta$ (=|A2−A1|) of a variation, before and after the actuation of the exhaust brake 10, of the intake-air amount 24*a* are obtained in the diagnosis circuit 25.

As shown in FIGS. 2(*a*) and 2(*b*), when the absolute value $\alpha$ of variation of the fuel-injection amount 23*a* is not less than the fuel-injection variation threshold $\alpha 0$ ($\alpha \geq \alpha 0$) and the absolute value $\beta$ of the variation of the intake-air amount 24*a* is not less than the intake-air variation threshold $\beta 0$ ($\beta \geq \beta 0$), then it is determined in the diagnosis circuit 25 that the exhaust brake 10 normally operates.

On the other hand, as shown in FIGS. 3(*a*) and 3(*b*), when the absolute value $\alpha$ of the variation of the fuel-injection amount 23*a* is less than the fuel-injection variation threshold $\alpha 0$ ($\alpha<\alpha 0$) and the absolute value $\beta$ of the variation of the intake-air amount 24*a* is less than the intake-air variation threshold $\beta 0$ ($\beta<\beta 0$), then it is determined in the diagnosis circuit 25 that the exhaust brake 10 has failure.

In this connection, if an auxiliary machine such as an air compressor in an air-conditioning apparatus in a vehicle, which is working, is stopped and timing thereof accidentally accords with the actuation of the exhaust brake 10, then increase of engine load by the actuation of the exhaust brake 10 is countervailed by lowering of the engine load due to the stopping of the auxiliary machine and in association therewith an increase degree of the fuel-injection amount 23*a* apparently becomes insubstantial as shown by virtual line in FIG. 2 (*a*). In such a case, in spite of the fact that the exhaust brake 10 normally operates, the exhaust brake 10 would be falsely determined to have failure if monitored were only the absolute value $\alpha$ of the variation, before and after the actuation of the exhaust brake 10, of the fuel-injection amount 23*a*.

In a case of the diesel engine 1 where air for the auxiliary machine such as the air compressor is taken from the intake pipe 5 downstream of the intake-air amount sensor 24, air is to be additionally took in for an amount of the air taken by the auxiliary machine upon the actuation of the auxiliary machine. As a result, to the contrary to the above, if the unworking auxiliary machine is actuated and timing thereof accidentally accords with the actuation of the exhaust brake 10, then the air to be taken by the auxiliary machine additionally flows through the intake pipe 5, so that a decrease degree of the intake-air amount 24*a* in association with the difficulty in inflow of the intake air into the cylinders caused by the enhanced exhaust resistance by the actuation of the exhaust brake 10 becomes apparently insubstantial as shown by virtual line in FIG. 2(*b*). In such a case, In spite of the fact that the exhaust brake 10 normally operates, the exhaust brake 10 would be falsely determined to have failure if monitored were only the absolute value $\beta$ of the variation, before and after the actuation of the exhaust brake 10, of the intake-air amount 24*a*.

Further, if the exhaust brake 10 actually has failure as shown in FIGS. 3(*a*) and 3(*b*) and the unworking auxiliary machine is actuated and timing thereof accidentally accords with the actuation of the exhaust brake 10, an increase degree of the fuel-injection amount 23*a* in association with increased engine load due to the actuation of the auxiliary machine is apparently clapped on as shown by virtual line in FIG. 3(*a*). In such a case, in spite of the fact that the exhaust brake 10 has failure, the exhaust brake 10 would be falsely determined to normally operate if monitored were only the absolute value $\alpha$ of the variation, before and after the actuation of the exhaust brake 10, of the fuel-injection amount 23*a*.

If the exhaust brake 10 actually has failure as shown in FIGS. 3(*a*) and 3(*b*) and the working auxiliary machine is stopped and timing thereof accidentally accords with the actuation of the exhaust brake 10, a decrease degree of the intake-air amount 24*a* in association with no air to be taken by the auxiliary machine additionally flowing through the intake pipe 5 is apparently expanded as shown by virtual line in FIG. 3(*b*). In such a case, in spite of the fact that the exhaust brake 10 has failure, the exhaust brake 10 would be falsely determined to normally operate if monitored were only the absolute value $\beta$ of the variation, before and after of the actuation of the exhaust brake 10, of the intake-air amount 24*a*.

However, in the embodiment, both the absolute values $\alpha$ and $\beta$ of the variations, before and after the actuation of the exhaust brake 10, of the fuel-injection and intake-air amounts 23*a* and 24*a* are monitored so that it can be surely determined whether the exhaust brake 10 normally operate or has failure.

Moreover, the diagnosis circuit 25 sets a first diagnosis-avoidance zone R1 where no diagnosis is made when, as shown in FIG. 4, the absolute value $\alpha$ of the variation of the fuel-injection amount 23*a* is not less than the fuel-injection variation threshold $\alpha 0$ ($\alpha \geq \alpha 0$) and the absolute value $\beta$ of the variation of the intake-air amount 24*a* is less than the intake-air variation threshold $\beta 0$ ($\beta<\beta 0$), which makes it possible to prevent false determination in association with reduction in the decrease degree of the intake-air amount 24*a* (see FIG. 2(*b*)) or expansion in the increase degree of the fuel-injection amount 23*a* (see FIG. 3(*a*)) when the unworking auxiliary machine is actuated.

The diagnosis circuit 25 further sets a second diagnosis-avoidance zone R2 where no diagnosis is made when, as shown in FIG. 4, the absolute value $\alpha$ of the variation of the fuel-injection amount 23*a* is less than the fuel-injection variation threshold $\alpha 0$ ($\alpha<\alpha 0$) and the absolute value $\beta$ of the variation of the intake-air amount 24*a* is not less than the intake-air variation threshold $\beta 0$ ($\beta \geq \beta 0$), which makes it possible to prevent false determination in association with reduction in the increase degree of the fuel-injection amount 23*a* (see FIG. 2(*a*)) or expansion in the decrease degree of the intake-air amount 24*a* (see FIG. 3(*b*)) when the working auxiliary machine is stopped.

Thus, failure of the exhaust brake 10 can be detected, and rising of the exhaust temperature for regeneration of the particulate filter 12 and unfreezing of the urea water 15 for the selective reduction catalyst 14 can be surely conducted.

It is to be understood that a device for diagnosing failure of an exhaust brake according to the invention is not limited to the above embodiment and that various changes and modifications may be made without departing from the scope of the invention.

REFERENCE SIGNS LIST

1 diesel engine (engine)
4 air (intake air)

7 exhaust gas
9 exhaust pipe
10 exhaust brake
12 particulate filter (aftertreatment device)
14 selective reduction catalyst (aftertreatment device)
23 fuel-injection amount sensor
23*a* fuel-injection amount
24 intake-air amount sensor
24*a* intake-air amount
25 diagnosis circuit
R1 first diagnosis-avoidance zone
R2 second diagnosis-avoidance zone
$\alpha$ absolute value of variation of fuel-injection amount
$\alpha$0 fuel-injection variation threshold
$\beta$ absolute value of variation of intake-air amount
$\beta$0 intake-air variation threshold

The invention claimed is:

1. A device for diagnosing failure of an exhaust brake, comprising:

a diagnosis circuit for determining, on the basis of absolute values of variations, before and after actuation of said exhaust brake, of fuel-injection and intake-air amounts, respectively, that the exhaust brake normally operates when the absolute value of the variation, before and after the actuation of said exhaust brake, of the fuel-injection amount is not less than a fuel-injection variation threshold and the absolute value of the variation, before and after the actuation of said exhaust brake, of the intake-air amount is not less than an intake-air variation threshold and determining that said exhaust brake has a failure when the absolute value of the variation, before and after the actuation of said exhaust brake, of said fuel-injection amount is less than the fuel-injection variation threshold and the absolute value of the variation, before and after the actuation of said exhaust brake, of said intake-air amount is less than the intake-air variation threshold, wherein upon determining that said exhaust brake has the failure, an exhaust flow rate is throttled to rise a temperature of an aftertreatment device for exhaust emission control incorporated in an exhaust pipe of an engine to a required temperature during idling.

2. The device for diagnosing failure of the exhaust brake as claimed in claim 1, wherein said diagnosis circuit sets a first diagnosis-avoidance zone where no diagnosis is made when the absolute value of the variation of said fuel-injection amount is not less than the fuel-injection variation threshold and the absolute value of the variation of said intake-air amount is less than the intake-air variation threshold as well as a second diagnosis-avoidance zone where no diagnosis is made when the absolute value of the variation of said fuel-injection amount is less than the fuel-injection variation threshold and the absolute value of the variation of said intake-air amount is not less than the intake-air variation threshold.

* * * * *